US006196921B1

(12) United States Patent
Larson

(10) Patent No.: US 6,196,921 B1
(45) Date of Patent: Mar. 6, 2001

(54) INTERCHANGEABLE MARTIAL ARTS WEAPONS SYSTEM

(76) Inventor: Randall L. Larson, P.O. Box 362, Kealakekua, HI (US) 96750

( * ) Notice: Subject to any disclaimer, the term of this patent is extended or adjusted under 35 U.S.C. 154(b) by 0 days.

(21) Appl. No.: 09/379,311

(22) Filed: Aug. 23, 1999

Related U.S. Application Data

(60) Provisional application No. 60/110,603, filed on Dec. 2, 1998.

(51) Int. Cl.[7] ..... F41B 15/02

(52) U.S. Cl. ..... 463/47.2; 463/47.5; 463/47.6

(58) Field of Search ..... 463/47.2, 47.4, 463/47.5, 47.6, 47.7; 135/74, 75

(56) References Cited

U.S. PATENT DOCUMENTS 4,132,408 * 1/1979 Sabat .
4,492,377 * 1/1985 Eby .
4,655,456 * 4/1987 Chen Dai .
4,682,774 * 7/1987 Holy .
5,509,653 * 4/1996 Parsons .
5,547,190 * 8/1996 Mackewich .

* cited by examiner

*Primary Examiner*—William M. Pierce
(74) *Attorney, Agent, or Firm*—Peter A. Borsari

(57) ABSTRACT

An interchangeable martial arts weapons system is provided comprising (a) a plurality of interchangeable connectable components comprising at least one long tube, at least one short tube, at least one T-handle and at least one illuminative tube, the ends of each of the interchangeable connectable components being provided with a female coupling fitting, (b) a plurality of coupling components comprising at least one and preferably a plurality of coupling studs and/or at least one and preferably a plurality of link connectors, the ends of each of the coupling components being provided with a male coupling fitting configured in such a manner that it is detachably securable to one of the female coupling fittings provided at the ends of the interchangeable connectable components and (c) a plurality of end caps being provided with the male coupling fitting. Each of the plurality of interchangeable connectable components can be detachably secured to another one of the plurality interchangeable connectable components by one of the plurality of coupling components. By selectively arranging a combination of the interchangeable connectable components and coupling components, a number of martial arts weapons can be created.

20 Claims, 2 Drawing Sheets

INTERCHANGEABLE MARTIAL ARTS WEAPONS SYSTEM

RELATED APPLICATIONS

This application claims priority from U.S. Provisional Application 60/110,603, filed Dec. 2, 1998.

FIELD OF INVENTION

The present invention relates to a martial arts weapons system for both entertainment use and martial art exercises. More particularly, the present invention relates to a martial arts weapons system having interchangeable parts which can be arranged quickly and easily into different combinations to form numerous martial art weapons. The versatile martial arts weapons system also provides spectacular lighting effects by utilizing a combination of small laser and glow stick technology, such that the various combinations of the martial arts weapons which can be created are illuminated by laser and/or glow in the dark.

BACKGROUND OF THE INVENTION

In the ancient practice of the martial arts, a number of weapons can be used, including the standard martial arts staff (both the Bo staff and the Jo staff), the Nunchaku, the San Setsu Kon or three-sectional staff, the Tonfa and the Escrima. Each of these weapons typically is used in martial arts exercises, competition and demonstrations. In addition, these weapons have been adapted for entertainment use. To develop a proficiency in using these weapons, countless hours of practice is required with each weapon. As the cost of these weapons can be expensive and as these weapons can be heavy, the purchase, storage and transport of the several weapons can be difficult to the average practitioner. As the interest in viewing martial arts demonstrations has grown, so too has the need for providing an entertainment aspect to the demonstrations, making the demonstrations more exciting visually for both the practitioner and the spectator.

The concept of developing a martial arts weapon having interchangeable components is known in the art. In U.S. Pat. No. 4,682,774 to Holy, issued Jul. 28, 1987, a collapsible, re-combinative martial arts weapon is disclosed which can be re-combined into several martial arts weapons. However, Holy's weapon is deficient in the kinds of weapons which can be constructed and is limited to assembling one weapon at a time. In addition, Holy does not provide the weapon with any kind of feature to enhance its entertainment value. Another combination martial arts weapon is disclosed in U.S. Pat. No. 4,132,408 to Sabat, issued Jan. 2, 1979, the weapon being a combination riot or night stick (e.g. a staff) and a nunchaku.

A lighted nunchaku is disclosed in U.S. Pat. No. 5,547,190 to Mackewich, Jr. et al., issued Aug. 20, 1996, the light source being an ordinary light bulb or a chemically activated light. However, Mackewich, Jr. et al. does not provide for the assembly of multiple martial arts weapons having the light source, but rather only contemplates a lighted nunchaku. In U.S. Pat. No. 4,070,023 to Cutler, a nunchaku is disclosed which comprises two perforated hollow metal tube weapons connected by a rope. The perforations provide a whistling sound when one metal tube is held and the other tube is whipped through the air. The whistling sound is the only feature of the Cutler weapon which could be considered an entertainment enhancement.

A need still exists to provide a martial arts weapons system having a plurality of interchangeable components for constructing multiple martial arts weapons. Such a system should provide for assembly of each martial art weapon in a quick and simple manner. In addition, such a martial arts weapons system should provide an interchangeable component which not only is used to assembly the weapon but also provides a fun and exciting entertainment feature. Further, such as martial arts weapons system should be inexpensive to manufacture and should be easy to store and transport.

SUMMARY OF THE INVENTION

Accordingly, it is an object of the present invention to provide a martial arts weapons systems having a plurality of interchangeable components for constructing multiple martial arts weapons including the standard martial arts staff (both the Bo staff and the Jo staff), the Nunchaku, the San Setsu Kon or three-sectional staff, the Tonfa and the Escrima.

It is another object of the present invention to provide a martial arts weapons system in which one of the interchangeable components is illuminative in order to enhance the entertainment aspect of the weapon.

It is an additional object of the present invention to provide a martial arts weapons system wherein the illuminative interchangeable component can be used in all of the potential martial arts weapons capable of being assembled.

It is still another object of the present invention to provide a martial arts weapons system in which each martial arts weapon can be assembled quickly and easily.

It is a further object of the present invention to provide a martial arts weapons system in the form of a kit wherein the plurality of interchangeable components can be easily stored and transported.

It is yet another object of the present invention to provide a martial arts weapons system which is inexpensive to manufacture.

Additional objects, advantages and novel features of the invention will be set forth in part of the description which follows, and in part will become apparent to those skilled in the art upon examination of the following specification or may be learned by practice of the invention.

BRIEF DESCRIPTION OF THE DRAWINGS

The present invention will be better understood with reference to the appended drawing sheets, wherein.

DETAILED DESCRIPTION

Figures 1, 2, 3, 4, 5, 6:
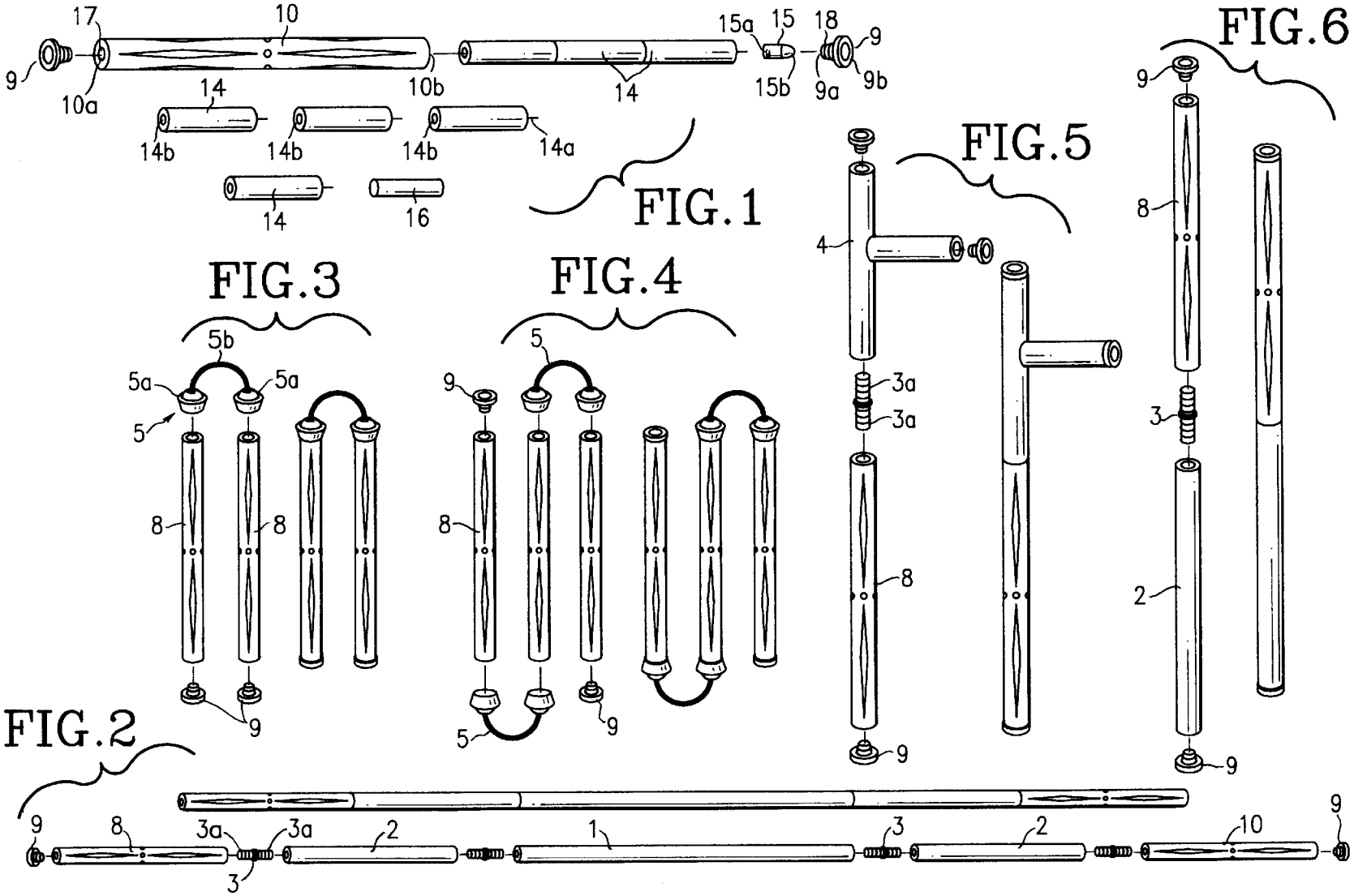
FIG. 1 is an assembly view of the illuminative perforated tube using glow sticks and laser end caps.
FIG. 2 is an assembly view showing the illuminative perforated tube in combination with other components to form a standard martial arts staff.
FIG. 3 is an assembly view showing the illuminative perforated tube in combination with other components to form a martial arts Nunchaku.
FIG. 4 is an assembly view showing the illuminative perforated tube in combination with other components to form the Chinese staff weapon San Setsu Kon or three-sectional staff.
FIG. 5 is an assembly view showing the illuminative perforated tube in combination with other components to form a martial arts Tonfa.
FIG. 6 is an assembly view showing the illuminative perforated tube in combination with other components to form Philippine short stick Escrima.

The present invention relates to martial arts weapons system having numerous interchangeable parts which can be assembled into different combinations to form various martial arts weapons, including for example, the standard martial arts staff (both the Bo staff and the Jo staff), the Nunchaku, the San Setsu Kon or three-sectional staff, the Tonfa and the Escrima. The martial arts weapons system of the present invention comprises (a) a plurality of interchangeable connectable components comprising at least one long tube, at least one short tube, at least one T-handle and at least one illuminative tube, the ends of each of the interchangeable connectable components being provided with a female coupling fitting, (b) a plurality of coupling components comprising at least one and preferably a plurality of coupling studs and/or at least one and preferably a plurality of link connectors, the ends of each of the coupling components being provided with a male coupling fitting configured in such a manner that it is detachably securable to one of the female coupling fittings provided at the ends of the interchangeable connectable components and (c) a plurality of end caps being provided with the male coupling fitting. Suitable female coupling fittings include, for example, an internally threaded end, an internally threaded female insert and the like. Suitable male coupling fittings include, for example an externally threaded end, an externally threaded male insert and the like. Alternatively, the male and female coupling fittings may be in the form of a snap/fit arrangement.

More specifically, the martial arts weapons system of the present invention comprises at least one long tube element 1, at least one short tube element 2, at least one coupling stud 3, at least one T-handle 4, at least one link connector 5, at least two (2) end caps 9 and at least one illuminative tube 8 having at least one laser element 15 or at least one glow stick 16. More preferably, the interchangeable martial arts weapons system comprises at least one long tube element 1, at least two (2) short tube elements 2, at least four (4) coupling studs 3, at least one T-handle 4, at least two (2) link connectors 5, at least three (3) end caps 9 and at least three illuminative tubes 8, each illuminative tube having at least one laser element 15 or at least one glow stick 16. Most preferably, the martial arts weapons system comprises three (3) long tube elements 1, four (4) short tube elements 2, four (4) coupling studs 3, two (2) T-handles 4, two (2) link connectors 5, four (4) end caps 9, four (4) illuminative tubes 8, twelve (12) color and designer insert tubes 14, four (4) laser elements 15 and eight (8) glow sticks 16.

One unique aspect of the interchangeable martial arts weapons system of the present invention is its spectacular lighting effects. The dazzling and dramatic lighting is provided by the inclusion of the illuminative tube 8. The illuminative tube is a perforated and/or vented tube which is illuminated with at least one glow stick, at least one laser element or a combination thereof. The illuminative tube can be used in the assembly of each of the martial arts weapons listed above as described hereinafter.

Referring to FIG. 1, the illuminative tube 8 comprises a hollow, vented and perforated tube 10, hereinafter referred to as the vented tube 10, at least one laser element 15 and at least one glow stick 16. Vented tube 10 comprises a first end 10*a* and a second end 10*b* and at least one longitudinal opening or vent 11. Each end 10*a* and 10*b* is provided with a female coupling fitting 17. As noted above, suitable female coupling elements are well known in the prior art and include for example, an internally threaded end, an internally threaded female insert and the like, hereinafter referred to as the female coupling fitting 17. Preferably, the vented tube is provided with a plurality of longitudinal vents 11 along the entire circumference of the tube. More preferably, the vented tube is provided with a plurality of center apertures 12 about the circumference of the tube and a plurality of longitudinal vents 11 disposed on both sides of the center apertures 12 as shown in FIG. 1. The vented tube 10 may be composed of any material which is capable of being vented and perforated, suitable examples of which include aluminum, steel, wood, fiberglass, plastic resins and similar rigid materials of relatively light weight.

The end cap 9 has a first end 9*a* configured with both an external male coupling fitting 18 and an internal female coupling element 19, and a second apertured end 9*b*, the aperture being disposed within the center of the end 9*b* as shown in FIG. 1. The external male coupling fitting 18 of first end 9*a* is fashioned to engage the female coupling fitting 17 as described above and can be an external threading designed to threadingly engage an internally threaded female coupling fitting. The end caps 9 can be composed of aluminum, hard plastic or any other suitable material which can be machined and threaded.

Illumination of the illuminative tube 8 is obtained by introducing at least one laser element 15, at least one glow stick 16 or a combination thereof to the vented tube 1. The laser element 15 preferably is a compact, bullet-shaped externally threaded laser of sufficient size to be introduced into the end cap 9 and is provided with a external male fitting 15*a*, such as an externally threaded end, a light emitting end 15*b* and an activating node or button 15*c*. In operation, the laser element 15 is introduced into the end cap 9 such that the light emitting end 15*b* extends into the apertured end 9*b* of the end cap, and the external male fitting 15*a* engages the internal female fitting 19 of end 9*a* of the end cap. As the laser element is introduced into the end cap, downward pressure on the activating node 15*c* activates the laser light. In this manner, light from the laser element 15 will emanate from the apertured end 9*b* of end cap 9. In a basic embodiment, a laser element 15 is inserted into either one or both end caps 9 and the end caps are threadingly secured to each end of the vented tube 10, thereby offering an illuminative tube 10 having laser light emanating from one or both ends.

The glow stick 16 is a conventional chemical glow stick having phosphorescent, fluorescent of similar glow capability. Numerous types of glow sticks currently are commercially available and are suitable for use in the present invention. In another basic embodiment, one or more glow sticks 16 is inserted directly into the vented tube 10 and retained therein once the end caps 9 having been threadingly secured to ends 10*a* and 10*b* of the vented tube, thereby providing an illuminative tube 10 having glow light emanating from the vent(s) 11 and/or center aperture(s) 12. In another embodiment, both the laser elements and glow sticks can be used to supply dual illumination.

Preferably, each glow stick is disposed within a color and designer insert tube 14 (hereinafter referred to as the insert tube 14) prior to its introduction or insertion into vented tube 10. The insert tube 14 is configured with a diameter slightly smaller than that of vented tube 10 such that it can be introduced into and retained within the vented tube 10. Each insert tube 14 is composed of a transparent or translucent material such that light emanating from the glow stick can be observed. The insert tube also can be designed with a variety of characteristics in order to provide more dazzling lighting effects; thus the insert tube can be colored, reflective, provided with a pattern, be imbedded with reflective pieces or a combination thereof. The insert tube 14 can be designed to be slightly shorter in length than the vented tube 10, thereby enabling only one insert tube 14 to be introduced into each vented tube, or can be considerably shorter in length than the vented tube 10, thereby allowing multiple insert tubes to be introduced into the vented tube. Preferably, the insert tube 14 ranges in length from about one fourth (¼) to about one half (½) the length of the vented tube 10. Thus, if the vented tube is about twelve (12) inches in length, the insert tube preferably is from about three (3) inches to about six (6) inches in length. Preferably, the length of the vented tube 10 is about twelve (12) inches and the length of each insert tube 14 is between about three (3) and four (4) inches, thereby allowing three or four insert tubes to be introduced into the vented tube. Multiple insert tubes can be fitted together by any means well known in the art. Preferably one end of each insert tube 14 has a male coupling fitting 14*a* and the opposite end of the insert tube has a female coupling fitting 14*b* such that they can be fitted together by a conventional male/female coupling arrangement. The use of multiple insert tubes 4 enables different color and design patterns to be combined and inserted into the vented tube 10. Once the insert tube(s) 14 containing the glow stick 16 has been introduced into the vented tube 10, a bullet element 15 can be threadingly secured to one or both of the end caps 9 and each end cap is screwed onto the one of the ends 10*a* and 10*b* of vented tube 10. The thus assembled illuminative tube 8 can be used as a stand alone item, such as a baton or staff, can be combined with one or more other illuminative tubes or can be combined with other components of the present invention to form a variety of martial arts weapons.

Each end of each long tube element 1, short tube element 2 and the T-handle 4 also are constructed with a female coupling fitting 17 as described above in order to provide female coupling means to each end of the tube or T-handle. The long tube element 1, short tube element 2 and T-handle 4 can be either solid or hollow and can be manufactured from a variety of materials, suitable examples of which include aluminum, steel, wood, fiberglass, plastic resins and similar rigid materials of relatively light weight. The length of each long tube 1 preferably is about two (2) feet while the length of each short tube 2 preferably is about one (1) foot. However, it is to be understood that the lengths of both the long tube element and short tube element can be varied without departing from the spirit of the present invention.

Each end of the connective coupling 3 is configured with a male coupling fitting 3*a*, such as an external threading, thereby providing a threaded male coupling to securely engage one of the female coupling fittings 17. The connective coupling 3 may be composed of any material capable of being threaded and sufficiently strong to couple and securely retain two of the interchangeable components of the present invention. Preferably, the connective coupling is a metal stud threaded at both ends. More preferably, the connective coupling is a spring-loaded self-tightening threaded metal stud, the stud being spring loaded with a centrally disposed marker such that when the connective coupling connects two of the components 1, 2, 4 and 10 together by threaded engagement, the spring creates a self-tightening effect, thus providing additional resistance to uncoupling during use.

Link connectors 5 are provided to form those types of martial arts weapons which require a flailing motion, such as the Nunchaku and San Setsu Kon. Each link connector comprises two male coupling components 5*a* joined by a flexible link 5*b*. The male coupling component 5*a* is configured to securely engage one of the female coupling fittings 17 as described above and thus may be in the form of an externally threaded end cap. Flexible link 5*b* may be any suitable flexible material, including for example, cord and chain.

Each of the plurality of interchangeable connectable components can be detachably secured to another one of the plurality interchangeable connectable components by one of the plurality of coupling components. By selectively arranging a combination of the interchangeable connectable components and coupling components, a number of martial arts weapons can be created. More particularly, the tube elements 1 and 2, the T-handle 4, and the vented tube 10 are joined together in a specific arrangement by the connective studs 3 and/or the link connectors 5 to form one of the several martial arts weapons contemplated by the present invention. Referring to FIG. 2, the standard Bo or Jo staff is formed by joining one long tube element 1, two short tube elements 2 and two illuminative tubes 10 with four (4) connective studs 3. More particularly, the female coupling fittings 17 of the long tube element 1, the two short tube elements 2 and the threaded end 10*a* of each illuminative tube 10 each engage and retain one male coupling fitting 3*a* of connective stud 3, thereby joining the three tube elements and two illuminative tubes as shown in FIG. 2. As the tubes 1, 2, and 10 are joined together, the springs in each connective stud 3 create a self-tightening effect as described above.

As shown in FIG. 3, a Nunchaku is created by joining two illuminative tubes 8 with a link connector 5, the open ends of the tubes 8 being closed by end caps 9. FIG. 4 illustrates the joining of three illuminative tubes 8 with two link connectors 5 to form a San Setsu Kon or three sectional staff. In FIG. 5, a Tonfa is constructed by joining one T-handle 4 and one illuminative tube 8 with a connective stud 3. The Philippine short stick Escrima is constructed by joining an illuminative tube 8 and a short tube element 2 with a connective stud 3 as shown in FIG. 6. It is to be understood that the formation of the several martial arts weapons as depicted shown in FIGS. 2 to 6 is merely illustrative of the many different ways in which these weapons can be constructed. For example, in the formation of a Bo or Jo staff as shown in FIG. 2 is approximately six (6) feet in length (using the preferred lengths of the tubes described above). However, the length of the staff can be increased or decreased depending upon the number of tubes used. Thus, a shorter staff can be constructed using a single illuminative tube 8, two illuminative tubes 8 and one short tube 2, two short tubes 2 and one illuminative tube 8 etc. Thus, any combination of the tubes 1, 2, 4 and 8 can be used in the assembly of the martial arts weapons. Of course, in order to provide the lighting effect of the weapon, at least one illuminative tube must be used in the assembly of each weapon.

Figure 7:
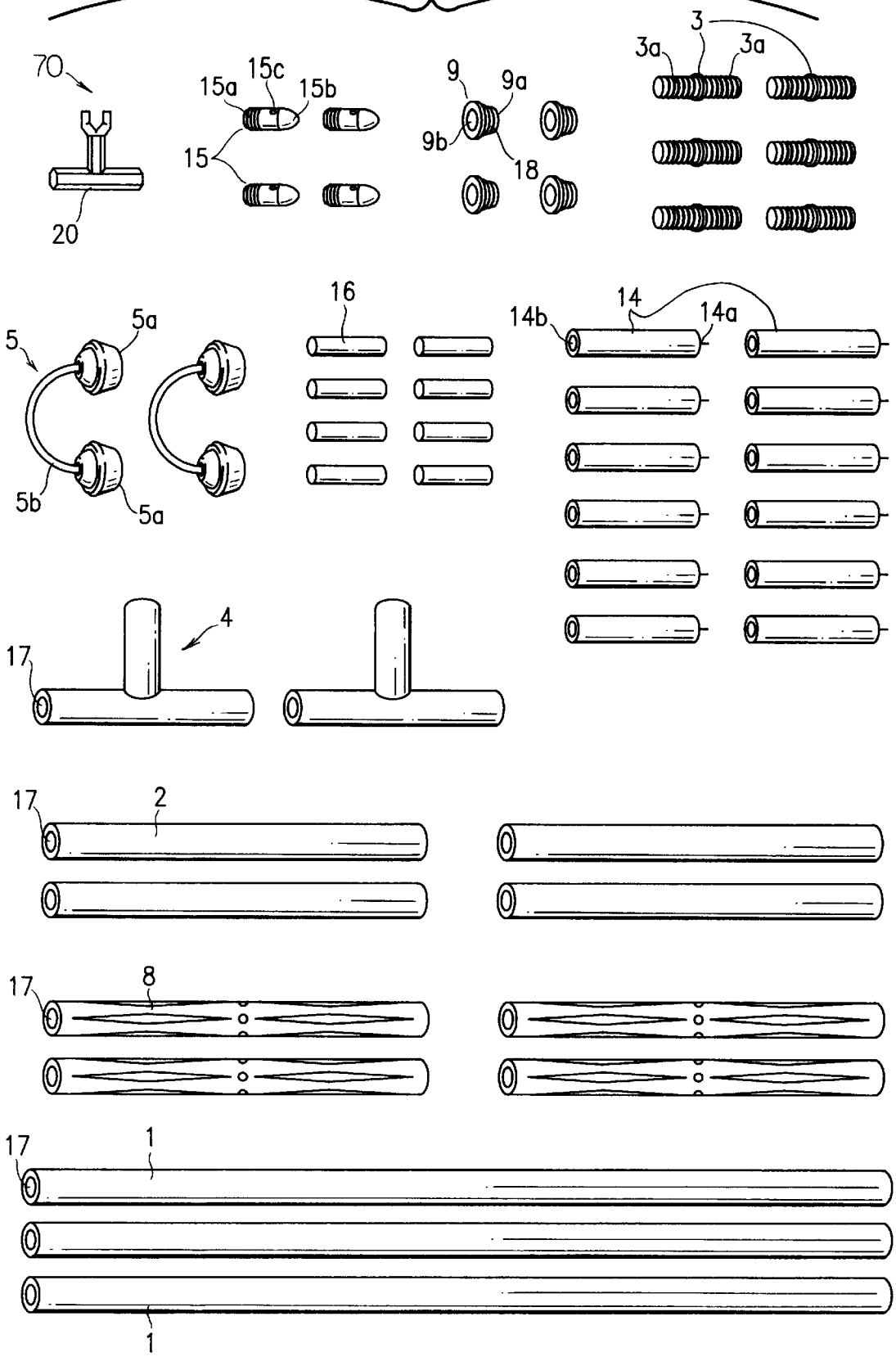
FIG. 7 shows a kit having numerous interchangeable parts for assembling the several martial arts weapons.

FIG. 7 illustrates the interchangeable martial arts weapons system of the present invention in the form of a kit 70 having a plurality of long tube elements 1, a plurality of short tube elements 2, a plurality of T-handles 4, a plurality of coupling studs 3, a plurality of link connectors 4, a plurality of vented tubes 10, a plurality of insert tubes 14, a plurality of laser elements 15 and a plurality of glow sticks 16. Preferably, as shown in FIG. 5, the kit comprises three (3) long tube elements 1, four (4) short tube elements 2, four (4) coupling studs 3, two (2) T-handles 4, two (2) link connectors 5, four (4) end caps 9, four (4) illuminative tubes 8, twelve (12) color and designer insert tubes 14, four (4) laser elements 15 and eight (8) glow sticks 16. However, it is to be understood that any number of components can be included in the kit without departing from the spirit of the present invention, providing that there is a sufficient number of components for assembling the martial arts weapons described above. The kit also may further comprise a wrench 20, such as a combination T-wrench. Preferably, the T-wrench includes a double ended allen wrench designed to fasten the end caps 9 and an open ended wrench designed to fasten the link is connectors 5.

While particular embodiments of the invention have been described, it will be understood, of course, that the invention is not limited thereto, and that many obvious modifications and variations can be made, and that such modifications and variations are intended to fall within the scope of the appended claims.

What is claimed is:

1. A martial arts weapons system having a plurality of interchangeable connectable components comprising at least one long tube having two female coupling ends, at least one short tube having two female coupling ends and at least one T-handle tube having three female coupling ends, each of said female coupling ends being a female coupling fitting; and a plurality of coupling components comprising a plurality of coupling studs and a plurality of link connectors, each of said plurality of coupling components having first and second male coupling ends, each of said first and second male coupling ends being a male coupling fitting configured to engage said female coupling fitting, wherein, an assembly is obtained when one of said plurality of interchangeable connectable components is joined another of said plurality of interchangeable connectable components by detachably securing said female coupling end of one of said plurality of interchangeable connectable components to said first male coupling end of one of said plurality of coupling components and detachably securing said female coupling end of said another of said plurality of interchangeable connectable components to said second male coupling end of one of said plurality coupling components, and wherein said assembly can be arranged between two or more said plurality of interchangeable connectable components in such a manner that a martial arts weapon is constructed.

2. The martial arts weapon system in accordance with claim 1, wherein said plurality of interchangeable connectable components further comprises at least one illuminative tube having two female coupling ends, said illuminative tube having at least one glow stick element, at least one laser element or a combination of at least one glow stick element and at least one laser element.

3. The martial arts weapons system in accordance with claim 2, further comprising at least one end cap having a first end provided with an external male coupling fitting configured to engage said female coupling fitting and an internal laser-element receiving female coupling fitting and a second end provided with an aperture, and wherein said laser element comprises a first end provided with a end-cap engaging male coupling fitting and a second light-emitting end, wherein, said laser element can be disposed within said end cap by detachably securing said end-cap engaging male coupling fitting to said internal laser-element receiving female coupling fitting in such a manner that said second light-emitting end of said laser element extends into said aperture of said second end of said end cap, and wherein said end cap having said laser element disposed therein can be detachably secured to said illuminative tube by detachably securing one of said female coupling ends of said illuminative tube with said external male coupling fitting of said end cap.

4. The martial arts weapons system in accordance with claim 2, wherein said illuminative tube further comprises at least one longitudinal vent and at least one glow stick capable of emitting light disposed within said illuminative tube in such a manner that light from said glow stick emanates from said at least one longitudinal vent.

5. The martial arts weapons system in accordance with claim 4, further comprising at least one insert tube capable of retaining said at least one glow stick and characterized as having a surface capable of allowing light from said glow stick to emanate therefrom, said insert tube configured in such a manner than it can be introduced into said illuminative tube.

6. The martial arts weapon system in accordance with claim 2, wherein said plurality of interchangeable connectable components comprises three long tubes, four short tubes and two T-handles and four illuminative tubes and said plurality of coupling components comprises four coupling studs and two link connectors and further comprising two end caps, each end cap having a first end provided with an external male coupling fitting configured to engage said female coupling fitting and an internal laser-element receiving female coupling fitting and a second end provided with an aperture.

7. The martial arts weapon system in accordance with claim 6, wherein when said assembly includes one of said long tubes, two of said short tubes, two of said illuminative tubes and three of said coupling studs, a martial arts weapon staff can be constructed.

8. The martial arts weapon system in accordance with claim 6, wherein when said assembly includes two of said illuminative tubes and one of said link connectors, a nunchaku martial arts weapon can be constructed.

9. The martial arts weapon system in accordance with claim 6, wherein when said assembly includes three said illuminative tubes and two of said link connectors, a san setsu kon martial arts weapon can be constructed.

10. The martial arts weapon system in accordance with claim 6, wherein when said assembly includes one of said illuminative tubes, one of said T-handles and one of said coupling studs, a tonfa martial arts weapon can be constructed.

11. The martial arts weapon system in accordance with claim 6, wherein when said assembly includes one of said short tubes, one of said illuminative tubes and one of said coupling studs, an Escrima martial arts weapon can be constructed.

12. The martial arts weapons system in accordance with claim 6, wherein each of said plurality of interchangeable connectable components is composed of a semi-rigid material selected from the group consisting of aluminum, steel, wood, fiberglass and plastic resins.

13. The martial arts weapons system in accordance with claim 2, wherein said illuminative tube is configured with at least one longitudinal vent and further comprises at least one insert tube capable of retaining said at least one glow stick, said at least one glow stick capable of emitting light, said insert tube characterized as having a surface capable of allowing light from said glow stick to emanate therefrom and configured in such a manner than it can be introduced into said illuminative tube in such a manner that light from said glow stick emanates through said surface of said insert tube and through said at least one longitudinal vent.

14. The martial arts weapons system in accordance with claim 13, wherein said at least one insert tube comprises three insert tubes, each of said three insert tubes capable of retaining a single glow stick and each of said three insert tubes being of sufficient size that all three of said insert tubes can be inserted into one illuminative tube.

15. The martial arts weapons system in accordance with claim 14, wherein said at least one end cap is one end cap detachably secured to said first end of said illuminative tube, aid one end cap having one of said at least one laser elements disposed therein.

16. The martial arts weapons system in accordance with claim 15, wherein said second end of said illuminative tube is detachably secured to another of said interchangeable connectable components.

17. An interchangeable martial arts weapons system comprising (1) a plurality of interchangeable connectable components comprising (a) at least one long tube element having a first end and a second end, each of said first end and said second end being provided with a female coupling fitting;

(b) at least one short tube element having a first end and a second end, each of said first end and said second end being provided with a female coupling fitting; and (c) at least one T-handle element having a first end, a second end and a third end, each of said first end, said second end and said third end being provided with a female coupling fitting;

(2) a plurality of coupling components comprising (e) at least two coupling studs, each having a first end and a second end, said first and second ends being provided with a male coupling fitting configured to engage said female coupling fitting;

(f) at least two link connectors, each having a first end and a second end, said first and second ends being provided with a male coupling fitting configured to engage said female coupling fitting, and (3) at least one secondary end cap having a first end providing with a male coupling fitting configured to engage said female coupling fitting.

18. The interchangeable martial arts weapons system in accordance with claim 17, in the form of a kit further comprising (d) at least one illuminative tube having a first end and a second end. each of said first end and said second end being provided with a female coupling fitting, said illuminative tube having at least one glow stick disposed therein and at least one end cap having a laser element .

19. The interchangeable martial arts weapons system in accordance with claim 18, further comprising a plurality of insert tubes, each of said plurality of insert tubes capable of retaining at least one glow stick and being of sufficient size to be disposed within said illuminative tube.

20. The interchangeable martial arts weapons system in accordance with claim 18, wherein said kit further comprises a combination tool for detachably securing said plurality of coupling components to said plurality of interchangeable connectable components.

* * * * *